United States Patent [19]

Fielder

[11] Patent Number: 4,945,597

[45] Date of Patent: Aug. 7, 1990

[54] ROTARY CLEANING DEVICE

[75] Inventor: Nicholas A. W. Fielder, West Australia, Australia

[73] Assignee: Dawson Offshore Pty. Ltd., Perth, Australia

[21] Appl. No.: 283,370

[22] PCT Filed: Apr. 24, 1987

[86] PCT No.: PCT/AU87/00115

§ 371 Date: Nov. 3, 1988

§ 102(e) Date: Nov. 3, 1988

[87] PCT Pub. No.: WO87/06507

PCT Pub. Date: Nov. 5, 1987

[30] Foreign Application Priority Data

Apr. 28, 1986 [AU] Australia ..... PH5633

[51] Int. Cl.[5] ..... B08B 9/02

[52] U.S. Cl. ..... 15/104.13

[58] Field of Search ..... 15/104.12, 104.13, 104.15; 29/81 F

[56] References Cited

U.S. PATENT DOCUMENTS

| | | | |
|---|---|---|---|
| 973,046 | 10/1910 | Jamison | 15/104.13 |
| 1,806,127 | 5/1931 | Staley | 15/104.13 |
| 2,397,156 | 3/1946 | Reynolds | 15/104.13 |
| 2,500,238 | 3/1950 | Baker et al. | 15/104.13 |

*Primary Examiner*—Edward L. Roberts

*Attorney, Agent, or Firm*—Harness, Dickey & Pierce

[57] ABSTRACT

A rotary cleaning element having a head adapted to be mounted for rotation about a central axis, the head supporting a plurality of radial arms which are spaced substantially angularly equidistant around the central axis, the free ends of the arms each support a tool which are rotatable about the end of the arm, the free ends of the radial arms intersect a plane which is transverse to the central axis and spaced axially outwardly from the head.

8 Claims, 5 Drawing Sheets

ROTARY CLEANING DEVICE

BACKGROUND OF THE INVENTION

THIS INVENTION relates to rotary cleaning elements.

A particular application of the invention relates to rotary cleaning elements which may be used to clean nonplanar surfaces such as pipes, tubing and the like.

SUMMARY OF THE INVENTION

In one form the invention resides in a rotary cleaning element comprising a head adapted to be mounted for rotation about a central axis, said head supporting three radial arms which are substantially angularly equidistant from each other, the free ends of the arm supporting tool bits which are rotatably mounted thereon about a longitudinal axis thereof the free ends of said radial arms intersecting a plane spaced axially outwardly from the hub.

BRIEF DESCRIPTION OF THE DRAWINGS

The invention will be more fully understood in the light of the following description of one specific embodiment. The description is made with reference to the accompanying drawings of which.

DETAILED DESCRIPTION OF THE PREFERRED EMBODIMENTS OF THE INVENTION

The embodiments are directed to a cleaning element which may be used with cleaning devices of the form disclosed in International Patent Applications PCT/AU86/00314 and PCT/AU86/00123. Such cleaning elements are used to clean surfaces which are generally of a cYlindrical configuration and it is necessary that the cleaning action applied to the surface by the cleaning element is maximised.

Figure 1:
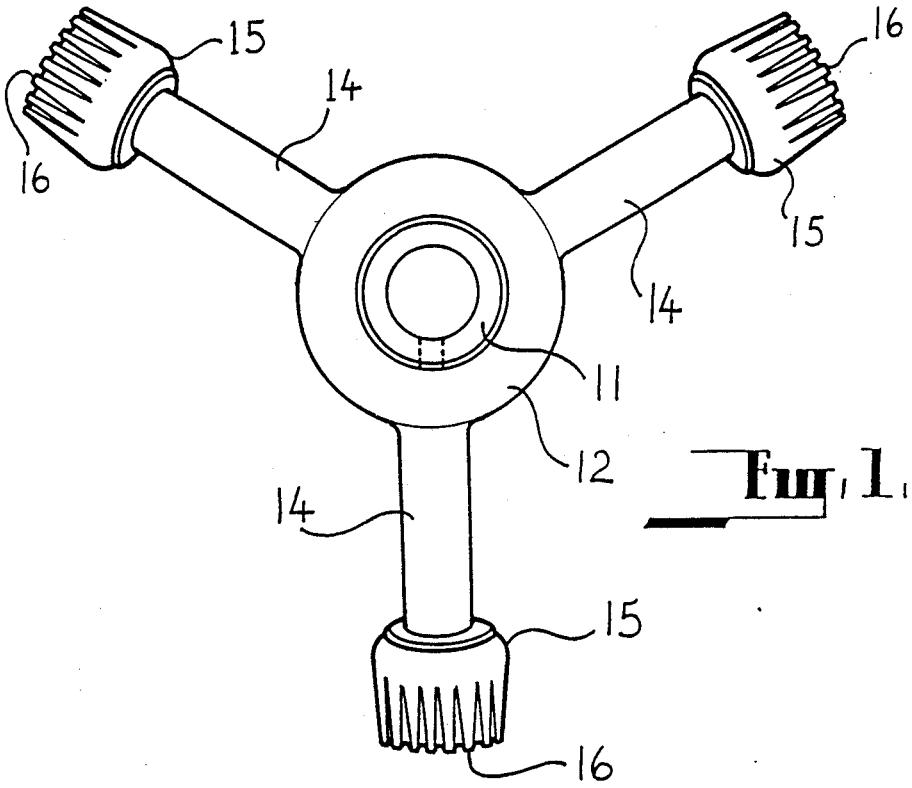
FIG. 1 is a plan view of the embodiment.
Figure 2:
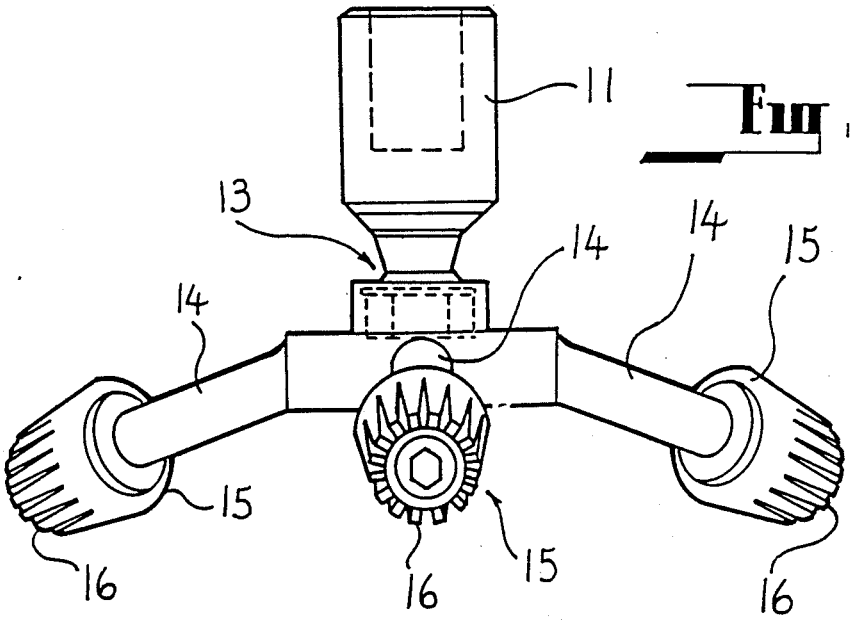
FIG. 2 is a side elevation of the embodiment.

The cleaning element of the first embodiment of FIGS. 1 and 2 comprises a substantially cylindrical hub member 11 which is to be fixed to a drive shaft for rotation with the drive shaft.

The hub member 11 supports a substantially circular head 12 through a universal joint 13 whereby the head is caused to rotate With the hub 11 but is capable of pivotal movement about a plurality of transverse axes of the hub 11. The head 12 supports three radial arms 14 which are spaced angularly equidistant around the central axis and are of a substantially equal length. The axes of the radial arms 14 angularly are offset from the transverse plane of the head 12 such that the plane intersected by the free ends of the radial arms 14 is spaced axially outwardly from the outer end of the head 12. The free end of each arm 14 supports a tool bit 15 which is freely rotatable on the radial arm about a substantially central axis of the radial arm 14. Each tool bit is of a substantially frusto conical configuration and the outer periphery of the tool bit is formed with a plurality of substantially axial ribs 16. The tool bits 15 are formed of a suitable tool grade hardened steel or like material As a result of the configuration of the radial arms all of the tools 15 can be brought into contact with a non-planar surface with substantially equal pressure being applied to the surface through each of the tools. The function of the universal joint permits the head 12 to adopt a variety of orientations on the hub 11 to enable the tools to be applied against the surface with equal pressure. On rotation of the head 12 through hub 11 the tool bits 15 are caused to roll over the surface which together with the force being applied to the surface by the hub will cause disintegration of any foreign material on the surface of the non-planar member. As a result foreign materials can be removed from a surface with reduced abrasive action compared to conventional brushes which rely substantially on abrasion.

The second, third and fourth embodiments are similar to the first embodiment and the same reference numerals have been used in FIGS. 3,4,5,6, and 7.

Figure 3:
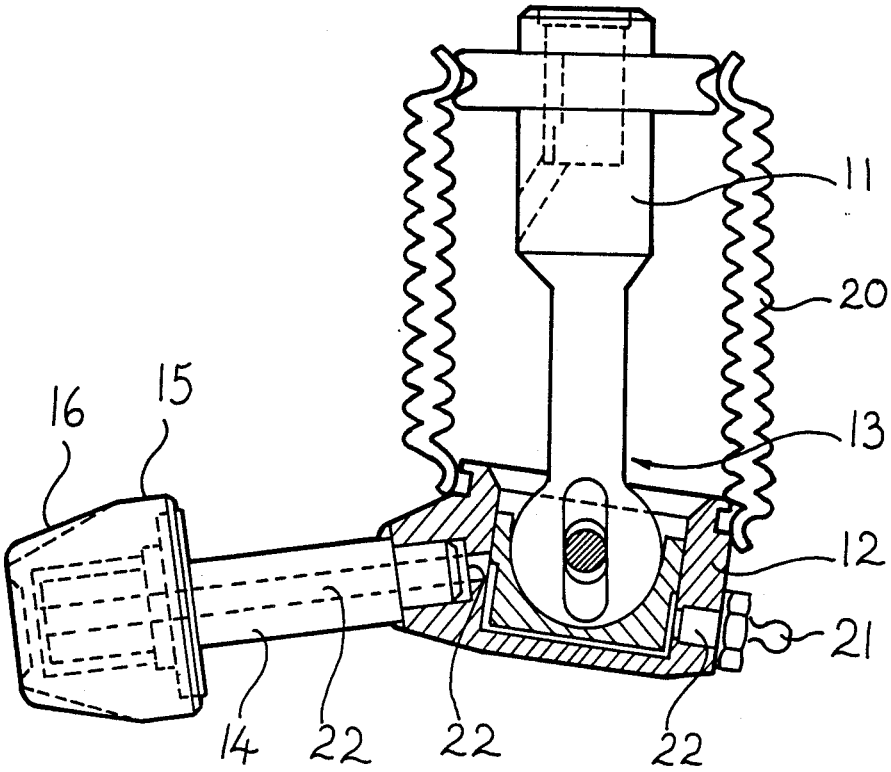
FIG. 3 is a part sectional view of a second embodiment showing its mounting when in position.

FIG. 3 illustrates the second embodiment in position in which a flexible cover or boot 20 covers the universal joint 13 between the hub 11 and the head 12.

In addition a grease nipple 21 is provided in the head 12 which communicates via passageways 22 in the head and arms with the mountings between the and tool bits for librication of the bearings therebetween.

Figure 4:
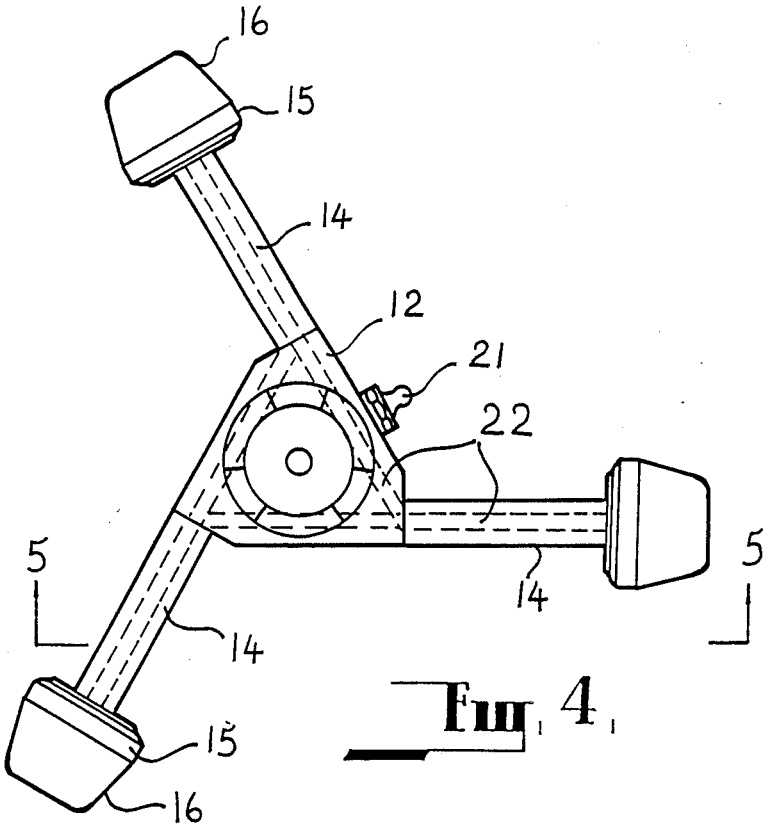
FIG. 4 is a plan view of a third embodiment.
Figure 5:
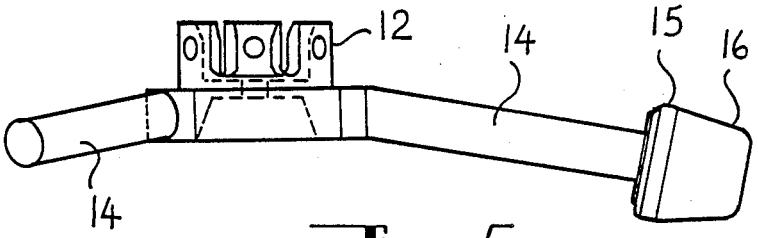
FIG. 5 is a partial view of the side elevation of the third embodiment along line 5—5 of FIG. 4.

The third embodiment of FIGS. 4 and 5 is intended to be fixed to a hub (not shown) to rotate therewith. No pivoted movement is provided between the head 12 and hub but if desired the hub and/or drive shaft (not shown) may be capable of some pivoted articulation.

Figure 6:
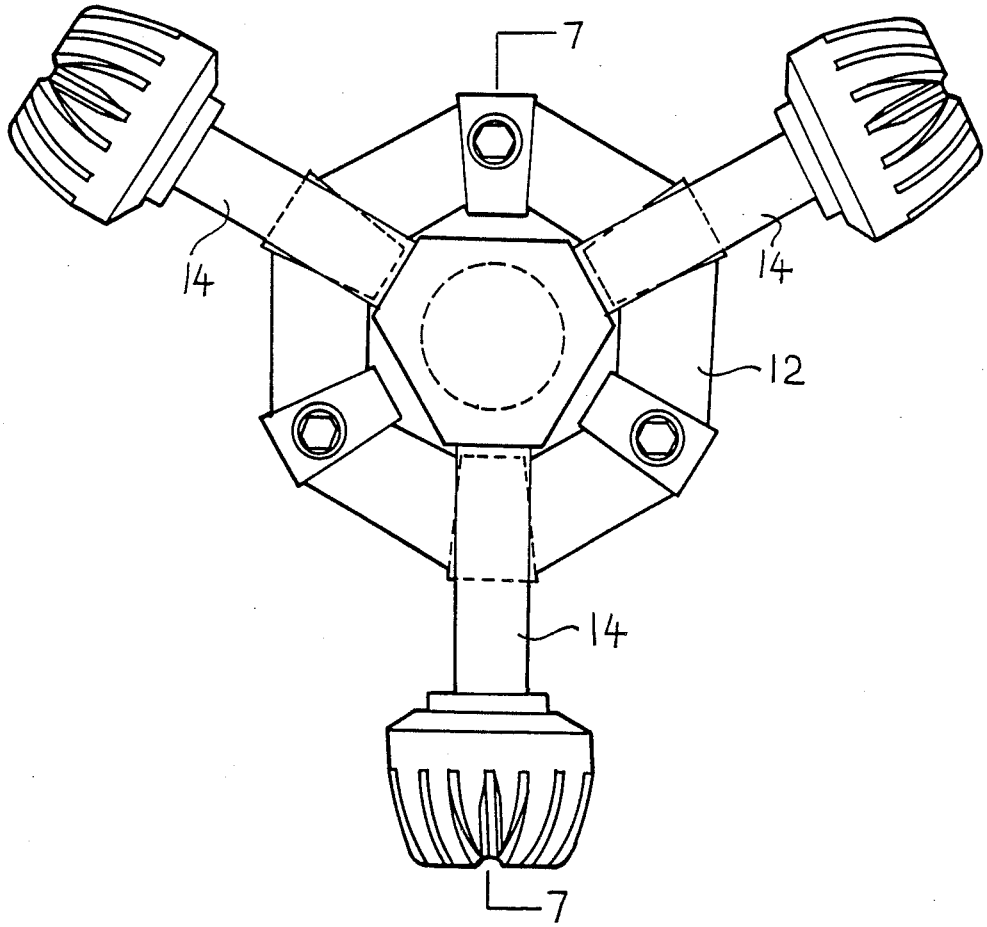
FIG. 6 is an underneath view of a fourth embodiment.
Figure 7:
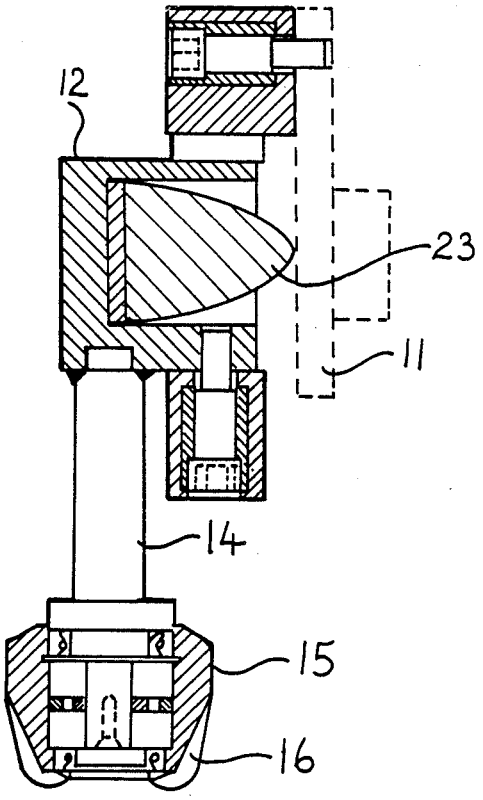
FIG. 7 is a sectional view of the fourth embodiment along line 7—7 of FIG. 6.

The fourth embodiment of FIGS. 6 and 7 is also extended to be fixed to a hub on drive shaft (not shown) without any pivoted interconnection clear therebetween. If desired the hub and/or drive shaft may be capable of some pivoted articulation In addition a resilient buffer 23 is provided in the head 12 for engagement between the head 12 and hub 11 to absorb some axial loadings or shocks therebetween.

It should be appreciated that the scope of the present invention need not be limited to the particular scope of the embodiment described above. In particular the invention need not be limited to the particular relationship between the hub 11 and head 12 or to the particular configuration of the tools 15.

I claim:

1. A rotary cleaning element comprising a head fixed to a hub adapted to be mounted for rotation about a central axis and pivotal about at least two perpendicular transverse axes of said hub, said head supporting a plurality of radial arms which are spaced substantially angularly equidistant around the central axis, the free ends of the arms each supporting a tool which is rotatable about the end of the arm, the free ends of said radial arms intersecting a plane transverse to the central axis and spaced axially outwardly from the hub.

2. A rotary cleaning element as recited at claim 1 comprising 3 radial arms.

3. A rotary cleaning element as claimed at claim 2 wherein the tools have a substantially frusto coaxial configuration.

4. A rotary cleaning element as claimed at claim 3 wherein the tools are formed with a plurality of axial ribs.

5. A rotary cleaning element as claimed at claim 2 wherein the tools are formed with a plurality of axial ribs.

6. A rotary cleaning element as claimed at claim 1 wherein the tools have a substantially frusto coaxial configuration.

7. A rotary cleaning element as claimed at claim 6 wherein the tools are formed with a plurality of axial ribs.

8. A rotary cleaning element as claimed at claim 1 wherein the tools are formed with a plurality of axial ribs.

* * * * *